United States Patent [19]

Grenfell et al.

[11] Patent Number: 4,542,319

[45] Date of Patent: Sep. 17, 1985

[54] MERCURY DISPENSER FOR ELECTRIC DISCHARGE LAMPS

[75] Inventors: Julian P. Grenfell, Woking; Stanley W. Stephens, Lightwater, both of England

[73] Assignee: Sale Tilney Technology PLC, London, England

[21] Appl. No.: 385,641

[22] PCT Filed: Oct. 19, 1981

[86] PCT No.: PCT/GB81/00228

§ 371 Date: Jun. 1, 1982

§ 102(e) Date: Jun. 1, 1982

[87] PCT Pub. No.: WO82/01440

PCT Pub. Date: Apr. 29, 1982

[30] Foreign Application Priority Data

Oct. 22, 1980 [GB] United Kingdom ..... 8034113

[51] Int. Cl.[4] ..... H01J 9/395; H01J 61/28

[52] U.S. Cl. ..... 313/546; 313/492; 313/326; 313/550; 445/9

[58] Field of Search ..... 313/546, 550, 545, 547, 313/551, 492, 326, 356; 445/9, 29, 38, 53, 70, 73

[56] References Cited

U.S. PATENT DOCUMENTS

| | | | |
|---|---|---|---|
| 3,722,976 | 3/1973 | Porta et al. | 445/9 |
| 3,764,842 | 9/1973 | Ridders et al. | 313/177 |
| 3,794,402 | 2/1974 | Ridders et al. | 313/177 |
| 4,056,750 | 11/1977 | Latassa | 313/177 |
| 4,182,971 | 1/1980 | Cassidy et al. | 313/177 |
| 4,282,455 | 8/1981 | Latassa et al. | 313/550 |

FOREIGN PATENT DOCUMENTS

| | | |
|---|---|---|
| 1475458 | 6/1977 | United Kingdom . |
| 2040554 | 8/1980 | United Kingdom . |
| 2063556 | 6/1981 | United Kingdom . |

*Primary Examiner*—David K. Moore
*Assistant Examiner*—K. Wieder
*Attorney, Agent, or Firm*—Kerkam, Stowell, Kondracki & Clarke

[57] ABSTRACT

A mercury dispenser for electric discharge lamps consists of welding a small metallic member (16) in the form of a "patch", to a portion of the surface of the cathode disintegration shield (10) and trapping a predetermined volume of mercury under the "patch". A dimple (17) may be formed in the shield (10) or in the member (16). The shield (10) may be formed from a continuous strip which is dimpled at a predetermined pitch, the dimples filled with mercury and the "patches" (16) welded over the dimples. The strip can then be cut into discrete "patched" sections to be bent into shields and assembled with the cathode structure. The mercury is liberated from under the "patch" by heating and vaporization, the vapor pressure forcing the "patch" open.

18 Claims, 20 Drawing Figures

MERCURY DISPENSER FOR ELECTRIC DISCHARGE LAMPS

This invention concerns a mercury dispenser for electric discharge lamps, especially lamps having a sealed transparent or translucent envelope containing at least one cathode, at least one gas at substantially reduced pressure and a certain amount of mercury. Such discharge lamps include fluorescent lamps and low pressure mercury discharge lamps, but may also include cold cathode glow discharge tubes.

In the manufacture of fluorescent tubes the introduction of an accurately metered amount of mercury into an already sealed and evacuated lamp envelope presents a great problem, not only technologically but also from the point of view of preventing the escape of mercury which is, of course, biologically toxic.

The conventional technique involves the use of an electromagnetic valve dispenser to dispense liquid mercury into a portion of an exhausting machine adjacent the exhaust tube (sometimes referred to as "tubulation") and then blowing or dropping the droplet of mercury into the interior of the envelope by means of a stream of argon, which is also the fill gas. This technique suffers from several drawbacks. Firstly, the dispenser cannot dispense an exact amount of mercury. Secondly, tiny amounts of mercury may never reach the tube envelope but may instead get stuck along the dispensing path, e.g. in the dispenser itself or in the exhaust tube. Thirdly, as the dispensing takes place in a hot environment, evaporation losses may occur. Because of these disadvantageous factors the amount of mercury usually dispensed considerably exceeds the actually desired amount and this is wasteful of a not-inexpensive raw material of finite abundance. Furthermore, on breakage of a tube, excessive amounts of harmful mercury may escape into the environment.

One prior proposal to overcome this drawback is to mount an intermetallic mercury compound around the cathode, on an anti-sputtering cathode shield, before tipping off the exhaust tube. After tipping-off the mercury is liberated from the compound when the latter irreversably breaks down under externally applied heating. While this method allows the dosage of mercury to be controlled better and reduced in magnitude, production is rendered more difficult and also more expensive.

In another prior proposal (U.S. Pat. No. 3,764,842) the required amount of mercury is sealed into a glass capsule in heat-conducting contact with an outer heater wire. A current is generated in the wire to melt and cut through the glass wall, whereby to release the mercury. The capsule and wire are mounted on a shield, known as the anti-sputtering or disintegration shield, (hereafter: disintegration shield) disposed about the cathode. The drawbacks are that the assembly and mounting of the capsule and heater wire are rather intricate and special measures have to be taken to prevent pieces of broken glass from falling off. The disintegration shield requires special shaping.

In yet other prior proposals, e.g. U.S. Pat. Nos. 3,794,402 and 4,182,971, a glass or metal capsule containing mercury has a sealed-in heating filament extending longitudinally through its interior. It is either connected to an external current source by way of current supply conductors passing through a wall of the tube, or a current is induced in it from a radio-frequency (R.F.) source. The heating current vaporises the mercury and the capsule cracks under the effect of the increased vapour pressure. The capsule may or may not be mounted about a disintegration shield but it has the disadvantage that it requires additional lead-in wire(s) through the wall of the tube or an R.F. heater. Also, the preparation of the capsule with a metal wire sealed in it is cumbersome and expensive.

In still another prior proposal (GB-PS No. 1,475,458) the mercury dispenser is located in the exhaust tube of the discharge lamp. The dispenser consists of two juxtaposed platelets of preferably dissimilar metal welded together and defining a depression therebetween to accommodate liquid mercury. On heating the vapour pressure of mercury forces the platelets apart to allow escape of the mercury vapour. In this proposal pumping the interior of the sealed envelope out through the exhaust tube is slowed down by the presence therein of the mercury dispenser. Some of the vapour may also condense in the exhaust tube and fail to reach the interior of the envelope.

It has also been proposed in U.S. Pat. No. 4,056,750 to form the disintegration shield with a circumferential gap and to weld a metallic mercury-containing capsule to the edges of the gap. But this proposal suffers from the disadvantages of having to prefabricate the capsules and welding them to the shield; not all such shields have circumferential gaps; and material may sputter off the cathode and pass through the portions of the gap not filled by the capsule to deposit, undesirably, on the wall of the envelope.

Still further, UK published patent application No. 2040554 discloses a two-compartment container attached to the foot or flare of a tubular fluorescent lamp mount. One compartment is permanently slightly open and contains an amalgam-forming metal alloy; the other compartment contains mercury. Once more, the disclosure is of intricate construction and high manufacturing costs. The "phosphor" on the inner wall of the tube is not protected adequately.

Finally, UK published patent application No. 2063556 discloses a mount for a discharge lamp wherein the cathode supported on a stem is encircled by a disintegration shield having a narrow circumferential gap between its ends. A mercury-containing sealed metal capsule is welded to the said ends so as to lie in the gap. The capsule is designed to rupture by R.F. heating, in a direction pointing towards the stem. This construction suffers essentially from the same disadvantages as that mentioned above in connection with U.S. Pat. No. 4,056,750.

The present invention seeks to overcome, or at least reduce, the disadvantages of known mercury dispensers. The invention is based on the concept of forming a mercury dispenser in the manner of a metallic "patch" on the anti-sputtering or disintegration shield, the outer surface of the shield constituting at least one wall of the "patch". The "patch" contains or traps the required amount of mercury by virtue of having one of its walls dimpled. In this way, no constraint is placed on the applicability of the invention; it is usable with discharge lamps with or without exhaust tubes; it may be employed with gapped, overlapping or endlessly looped disintegration shields; it utilises less extraneous material, or none at all, for the dispenser itself; does not use glass; is less prone to the risk of loose chips of material damaging the phosphor on the lamp wall after rupture of the dispenser; is easy to manufacture; and lends itself to various forms of heating to release mercury.

According to one aspect of this invention there is provided a mercury dispenser for an electric discharge lamp comprising at least two metallic walls shaped and sealed together so as to form a heat-rupturable container for mercury or a mercury-containing intermetallic compound, characterised in that at least one of said walls forms part of a cathode disintegration shield or of a blank for a cathode disintegration shield.

The invention in another aspect also extends to an article of manufacture comprising a continuous flat ribbon of metal provided with a plurality of discrete heat-rupturable containers for mercury or a mercury-containing intermetallic compound, characterised in that said ribbon is disintegration shield blank material severable into individual blanks each of which is foldable into discrete shields.

A further aspect of the invention embraces an electric discharge lamp having a sealed and evacuated envelope a mount sealed to the envelope the mount supporting a cathode and a disintegration shield around said cathode, characterised in that said shield forms at least one wall of a mercury dispenser.

In a further aspect of the present invention there is provided a method of manufacturing a mercury dispenser comprising forming a continuous ribbon with depressions formed at a predetermined spacing, placing in each depression liquid mercury or a mercury-containing intermetallic compound and securing a metallic wall over each depression so as to form a sealed container of mercury, characterised in that said ribbon is a blank of disintegration shield material and said wall is a discrete metallic member or a cut-and-folded part of said blank.

In one preferred embodiment the reduced shield cross-section is obtained by notching the shield with generally L-shaped notches to produce lugs or tags on either side of the "patch" and the lugs or tags are then bent inwardly (i.e. towards the position of the cathode) to prevent, in use, material sputtered off the cathode from reaching the envelope wall.

Alternatively, the "patch" may be off-centre with respect to the width of the shield and in the larger portion of the shield adjacent the "patch" an aperture is formed.

In yet another alternative a tongue or tag is formed on one circumferential end of an open-looped shield, and is then welded to the other circumferential end of the shield, the "patch" being located on this tongue or tag, to form a closed loop.

Preferably, the shield is formed with overlapping ends having a transverse (radial) gap therebetween, the container being disposed in said gap.

Preferred embodiments of the invention, purely by way of example, are illustrated in and will be described with reference to the accompanying schematic drawings, wherein.

Figure 1:
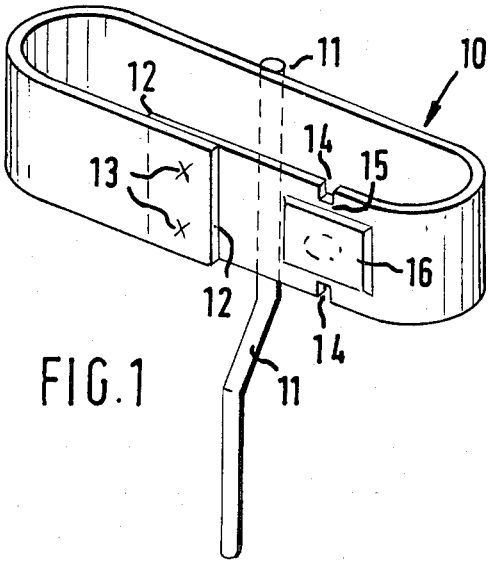
FIG. 1 is a perspective view of a mercury dispenser for an electric discharge lamp, mounted on and forming part of the anti-sputtering cathode shield and the stay wire that carries the latter.
Figure 2:
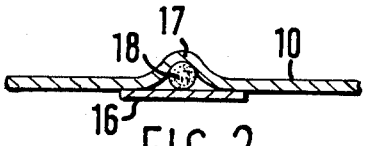
FIG. 2 is a cross-section of the mercury dispenser of FIG. 1.
Figure 5:
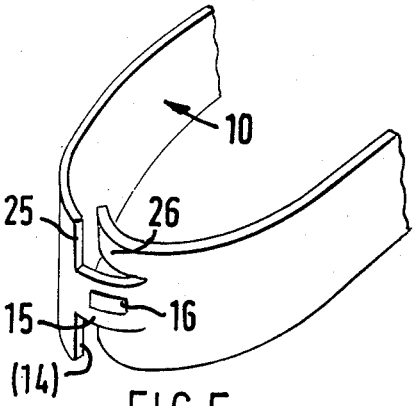
Figure 3:
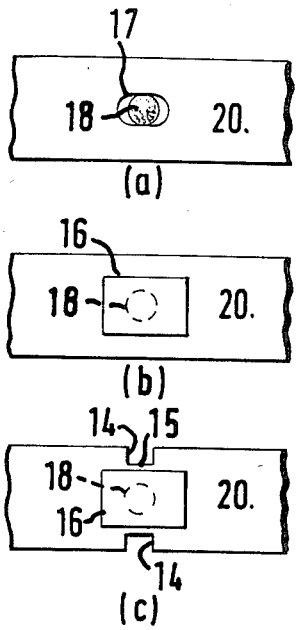
Figure 4:
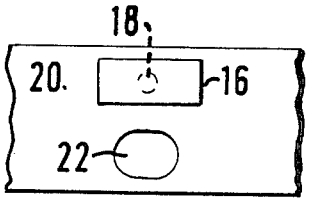
Figure 6:
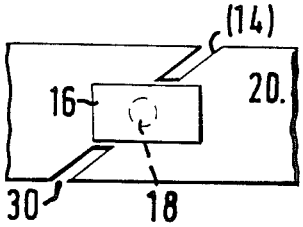
Figure 8:
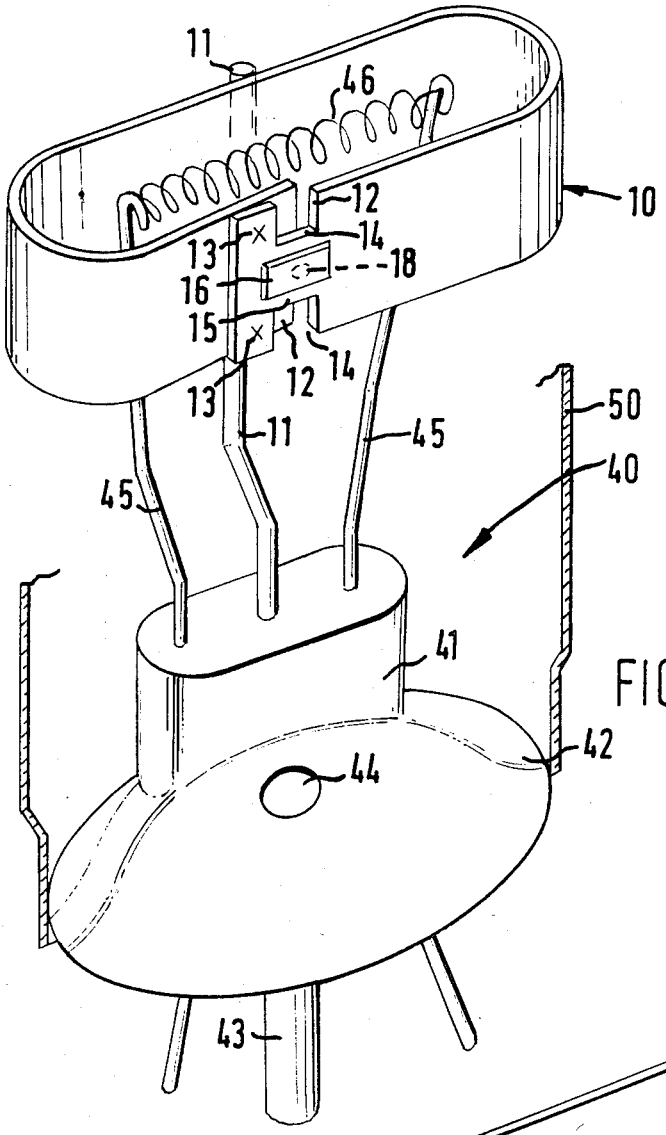
Figure 7:
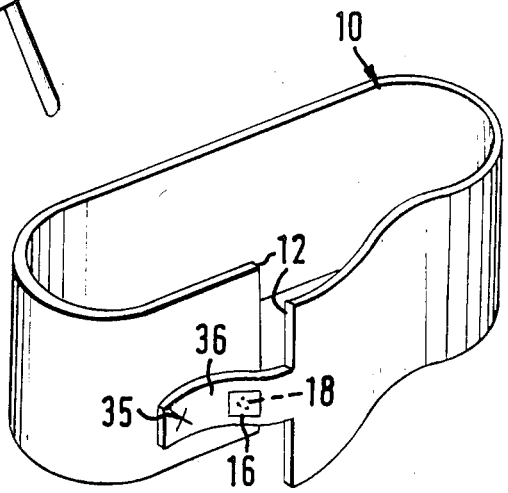
Figure 9:
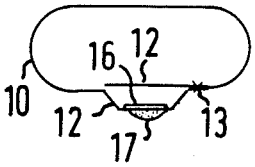
Figure 15:
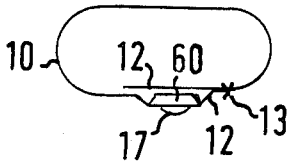
Figure 16:
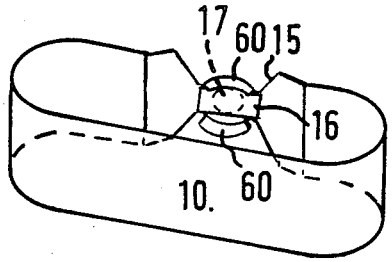
Figure 17:
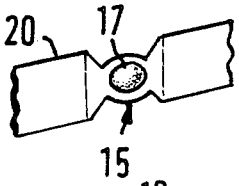
Figure 18:
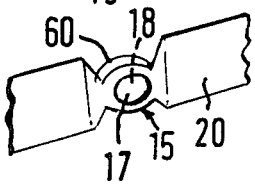
Figure 19:
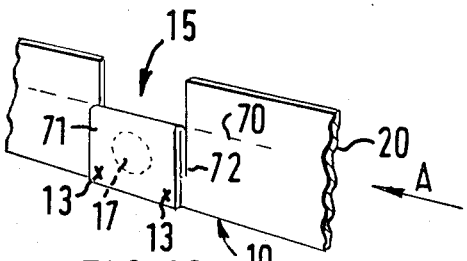
Figure 20:
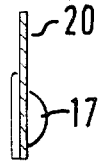

FIGS. 3(*a*), (*b*) and (*c*) show successive steps in the manufacture of a mercury dispenser according to FIGS. 1 and 2;

FIGS. 4 to 7 are views of further embodiments of mercury dispensers according to the invention, wherein FIGS. 4 and 6 are fragmentary elevations while FIG. 5 is a fragmentary perspective view and FIG. 7 is a perspective view of an anti-sputtering cathode shield incorporating the mercury dispenser;

FIG. 8 is a perspective view of a mount of a fluorescent lamp including a further embodiment of a mercury dispenser according to the invention;

FIGS. 9 to 15 are respective schematic elevations of still further embodiments of the invention;

FIG. 16 is a perspective view of an enlarged scale of the embodiment of FIG. 15 but with one overlapping end portion of the shield removed for the sake of clarity;

FIG. 17 is a detail view of the mercury dispenser shown in FIGS. 9 to 14;

FIG. 18 is a detail view of the mercury dispenser shown in FIGS. 15 and 16; and FIGS. 19 and 20 are, respectively, a fragmentary perspective view and a side view taken on the arrow A in FIG. 19, of a further embodiment of the invention wherein the "patch" is formed wholly of the disintegration shield.

Referring first to FIGS. 1 to 3, there is shown a disintegration shield 10 surrounding the cathode of a fluorescent lamp tube. The shield is of metallic material and is welded to one end of a stay wire 11 the other end of which is sealed to a glass pinched stem. The assembly or sub-unit consisting of stem, lead-in wires and cathode filament is collectively referred to as a "mount" and is shown in FIG. 8, to be described below.

The shield 10 is in the form of a metal strip bent into a loop with overlapping ends 12 which, in this embodiment, are welded together in the region of overlap at 13. At a position offset from the overlap, the shield 10 has two lateral notches 14 to produce a reduced-section portion 15.

A small piece of metallic member 16 is welded to the outer surface of the reduced-section portion 15 of the shield 10. As may be seen, the appearance of the weld is that of a raised "patch". The length of the member 16 is a small fraction of the circumferential length of the shield 10 while its width is somewhat less than that of the portion 15. The shield 10 and the member 16 may be of the same or of a different metallic material.

One or both of the shield 10 and the member is formed with a depression 17 which is filled with a predetermined amount of liquid mercury 18 (or a mercury-releasing amalgam or intermetallic compound) before the welding step. In this way, the member 16 and the co-operating portion of the shield 10 together form a mercury dispenser.

The liquid mercury is in use heated up and vapourised. The vapour pressure forces the dispenser open, e.g. at the welds of the "patch", to allow mercury vapour to escape into the interior of the lamp tube.

The heating may be effected e.g. external irradiation by an electron beam or laser beam or by induced electric currents. To this end, radio frequency (R.F.) coils (not shown) are used.

The notches 14 forming the reduced-section portion 15 are effective to create a current flow path of higher current density in order to concentrate the heating effect in the area of the "patch" without wasting energy by heating the rest of the shield 10 to a high temperature.

FIG. 3(*a*) shows an initial stage of manufacture of one embodiment of a mercury dispenser. A long flat strip 20 of shield material (blank) is intermittently dimpled and each dimple 17 is then filled with a droplet of liquid mercury 18 of predetermined volume. As may be seen in FIG. 3(*b*), each dimple 17 is then covered by a member 16 which is then welded to the strip 20 to form "patches". Then (FIG. 3(*c*)) the notches 14 are produced.

The resulting semi-finished product may then be severed between adjacent dimples 17, bent into a shield in a conventional manner and assembled with the mount in a conventional machine, known as a "mount mill", not shown.

FIG. 4 shows an alternative embodiment wherein the dispenser is offset from the longitudinal centre-line of the strip 20 and the latter is not notched. However, the same enhanced current density can be achieved by forming a hole 22 alongside the patch. Such holes 22 along the length of the strip 20 may then be utilised as sprocket holes for engagement by a gear tooth or other projection of a feeding mechanism for feeding the strip 20 and/or as locating holes for correctly positioning the strip 20 in the severing operation or any other subsequent manipulation of the strip 20.

Conceivably, the dimple 17 could be formed in the member 16 and the shield 10 welded to the latter; both parts 10 and 16 could also be dimpled.

In the embodiments of FIGS. 1 to 4, material sputtered off the cathode in use may pass through the notches 14 or holes 22 and deposit on the internal "phosphor" coating of the lamp envelope. This is generally undesirable and the embodiment of FIG. 5 reduces this drawback.

Here the notches 25 are generally L-shaped, resulting in tabs 26 which are bent away from the reduced portion 15 and inwardly towards the cathode. In this way, the tabs 26 block a purely radial path of movement for sputtered-off particles.

Alternatively, as in the FIG. 6 embodiment, notches 30 running in a direction making an acute angle with the central longitudinal axis of the strip 20 may be made.

In a further embodiment shown in FIG. 7, the ends 12 of the shield overlap slightly but are spaced apart. They shadow the cathode from the tube wall but are connected together by welding (at 35) a tongue 36 of reduced cross-section projecting from one end 12. The tongue 36 carries the "patch", i.e. the member 16 is welded over a dimple in the tongue 36 filled with mercury.

FIG. 8 shows a further embodiment and illustrates the entire mount structure 40. This consists of a stem 41 with a flare 42, an exhaust tube 43 terminating in a hole 44 in the stem 41, a pair of spaced lead-in wires 45 pinch-sealed in the stem, a cathode filament 46 secured between the upper ends (as viewed) of the lead-in wires 45, and the stay wire 11 sealed at one end in the stem 41 and welded at the other end to the shield 10. A tubular envelope is fused to the flare 42.

The shield 10 has overlapping ends 12 welded together at 13. The inner end is bent inwardly to provide shielding for notches 14 cut into the shield 10 to form the reduced-section portion 15. In this embodiment this portion 15 is formed in the region of overlap between the ends. The "patch" or mercury dispenser is disposed between the notches 14.

FIGS. 9 to 16 show various further embodiments of mercury dispensers according to the invention, utilizing like reference numbers for like parts. In all these embodiments the "patch" is located in the region of an overlap between the ends 12 of the shield 10. The ends 12 are welded together at 13. This overlap helps to protect the "phosphor" on the wall of the envelope.

In FIGS. 9, 11, 14 and 15 the location of the "patch" is such that in use the "patch" bursts inwardly, i.e. towards the cathode but the inner of the overlapping ends 12 is interposed between the cathode and the "patch". This may be a useful feature where there is a risk that heat from the cathode in the cathode activation or aging step of fluorescent lamp manufacture could prematurely release the mercury from the "patch". Conversely, in FIGS. 10, 12 and 13 the "patch" is designed to burst outwardly where the risk of damage to the "phosphor" is not considered important.

Figure 10:
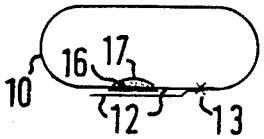
Figure 11:
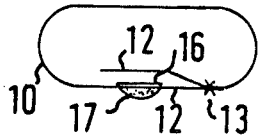
Figure 12:
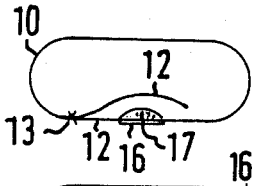
Figure 13:
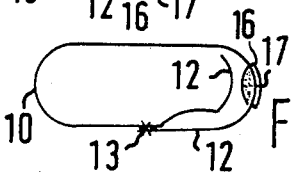
Figure 14:
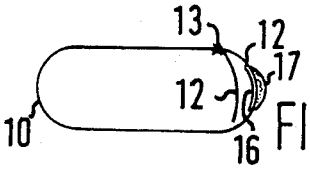

These Figures also show that the "patch" may be on the outer one of the two overlapping ends 12, as shown in FIGS. 9, 11, and 12 to 16, but it may also be on the inner one, as in FIG. 10. Considering the shield 10 as an ellipse, the "patch" may be on the minor axis, as in FIGS. 9 to 12, 15 and 16, or on the major axis, as in FIGS. 13 and 14.

Referring to FIGS. 15 and 16, in order further to reduce any damage to the "phosphor" from the bursting of the mercury dispenser the notched portion 15 is formed with integral bent tabs 60 which may be seen more clearly in FIG. 16 where the inner one of the overlapping ends 12 has been removed, for clarity.

FIG. 17 shows in greater detail how the shield is notched and the "patch" applied in the embodiments of FIGS. 9 to 14. FIG. 18 on the other hand, is analogous to FIG. 17 but applies to the shield of FIG. 15.

Finally, in FIGS. 19 and 20 there is shown an embodiment in which the mercury dispenser is formed wholly and exclusively of the shield 10. A pair of parallel, transverse cuts are made from one edge of the strip 20 up to a fold line 70 to form a reduced portion 15. The uncut portion receives a depression 17 for the mercury. The cut portion 71 is then folded about line 70 to overlie the uncut, dimpled and mercury-filled portion and is welded to it at 13. The cuts may extend beyond the fold line 70, to form slits 72 further to reduce the width of the current flow path and so to increase current density in the region of the "patch".

In any of the foregoing embodiments the shield may have two separate patches, the first one containing mercury and the second a metal or alloy, such as indium or indium-bismuth, which can form an amalgam with the mercury. This second patch may be slightly open all the time. In this way the atmosphere inside the envelope may be better controlled.

We claim:

1. A heat rupturable mercury dispenser in combination with a cathode disintegration shield, the combination comprising:

said disintegration shield comprising a single piece of metal and having a side face;

said mercury dispenser comprising two elements secured together to define a sealed space between said elements;

said sealed space containing a material selected from the group consisting of mercury and mercury-containing intermetallic compounds; and one of said elements of said mercury dispenser being a wall secured to a portion only of said side face of said disintegration shield and the other of said elements being said portion of said side face to which said wall is secured.

2. The invention according to claim 1, wherein said wall is integral with said shield.

3. The invention according to claim 2, wherein said wall is formed by transversely cutting said disintegration shield from one edge thereof, folding the cut portion over about a fold line that extends generally lengthwise of said shield, and securing said cut portion to the opposite edge region so as to form said dispenser.

4. The invention according to claim 1 wherein at least one of said wall and said side face portion is formed with a depression for containing said material.

5. The invention according to claim 1, wherein said wall is very small in length in relation to the circumferential length of said shield.

6. The invention according to claim 1, wherein said shield is wider than said wall but is of reduced cross-section in said portion thereof where said wall is secured thereto.

7. The invention according to claim 1, wherein said shield is formed with overlapping ends having a radial gap therebetween, said sealed space being defined in said gap.

8. A method of manufacturing a heat rupturable mercury dispenser combined with a disintegration shield that has a side face and that is wholly constituted by a single piece of metal, said method comprising:

securing a wall to a portion only of said side face such that a sealed space is defined between said face portion and said wall;

filling said space prior to sealing with a material selected from the group consisting of liquid mercury and mercury-containing intermetallic compounds; and sealing said space.

9. A heat rupturable mercury dispenser in combination with a cathode disintegration shield blank, comprising:

said disintegration shield blank comprising a single piece of metal and having a side face;

said mercury dispenser comprising two elements secured together to define a sealed space between said elements, said sealed space containing a material selected from the group consisting of mercury and mercury-containing intermetallic compounds; and one of said elements of said mercury dispenser being a wall secured to a portion only of said side face of said disintegration shield blank and the other of said elements being said portion of said side face to which said wall is secured.

10. The invention according to claim 9, wherein said wall is integral with said shield blank.

11. The invention according to claim 10, wherein said wall is formed by transversely cutting said shield blank from one edge thereof, folding the cut portion over about a fold line that extends generally lengthwise of said shield blank, and securing said cut portion to the opposite edge region so as to form said dispenser.

12. The invention according to claim 9, wherein at least one of said wall and said side face portion is formed with a depression for containing said material.

13. The invention according to claim 9, wherein said wall is very small in length in relation to the length of said shield blank.

14. The invention according to claim 9, wherein said shield blank is wider than said wall but is of reduced cross-section in said portion thereof where said wall is secured thereto.

15. A method of manufacturing a heat rupturable mercury dispenser combined with a blank for a disintegration shield that has a side face and that is wholly constituted by a single piece of metal, said method comprising:

securing a wall to a portion only of said side face of said disintegration shield blank such that a sealed space is defined between said face portion and said wall;

filling said space prior to sealing with a material selected from the group consisting of liquid mercury and mercury-containing intermetallic compounds; and sealing said space.

16. A method as claimed in claim 15, wherein said disintegration shield blank comprises a ribbon of such blanks, and wherein said method further includes severing said ribbon into individual disintegration shield blanks.

17. An electric discharge lamp comprising:

a sealed and evacuated envelope;

a cathode supported within said envelope;

a disintegration shield formed from a single piece of metal extending around said cathode and having a side face; and a wall secured to a portion only of said shield side face, a sealed space being defined between said wall and said portion of said shield side face, said wall, shield side face and space constituting a heat rupturable container for a material selected from the group consisting of liquid mercury and mercury-containing intermetallic compounds.

18. A plurality of combined heat rupturable mercury dispensers and disintegration shield blanks for use in electric discharge lamps, comprising:

a flat ribbon severable into complete individual disintegration shield blanks, each shield blank having a side face and being constituted by a single piece of metal;

a wall secured to a portion only of said side face of each of said shield blanks; and a sealed space being defined between each said wall and said side face portion to which said wall is secured, each of said spaces containing a material selected from the group consisting of liquid mercury and mercury-containing intermetallic compounds.

* * * * *